US005524840A

United States Patent [19]

Gygi

[11] Patent Number: 5,524,840

[45] Date of Patent: Jun. 11, 1996

[54] MILLING DEVICE

[76] Inventor: Martin H. Gygi, Stümelweg, CH-8914 Aeugst am Albis, Switzerland

[21] Appl. No.: 355,965

[22] Filed: Dec. 14, 1994

[30] Foreign Application Priority Data

Dec. 17, 1993 [CH] Switzerland ..... 3788/93

[51] Int. Cl.[6] ..... B02C 15/02

[52] U.S. Cl. ..... 241/117; 241/228

[58] Field of Search ..... 241/117, 118, 241/228, 229, 221

[56] References Cited

U.S. PATENT DOCUMENTS

| | | | |
|---|---|---|---|
| 1,603,639 | 10/1926 | Reed | 241/117 X |
| 2,303,387 | 12/1942 | Piper . | |
| 3,888,426 | 6/1975 | Urschel et al. | 241/221 X |
| 4,572,442 | 2/1986 | Sigg | 241/117 |
| 4,860,962 | 8/1989 | Kiefer et al. | 241/117 |

FOREIGN PATENT DOCUMENTS

| | | | |
|---|---|---|---|
| 0102645 | 3/1984 | European Pat. Off. . | |
| 349886 | 7/1905 | France . | |
| 622491 | 9/1978 | U.S.S.R. | 241/221 |
| 8706500 | 11/1987 | WIPO . | |

*Primary Examiner*—John Husar
*Attorney, Agent, or Firm*—Ladas & Parry

[57] ABSTRACT

The milling device comprises a milling roller running in a milling ring, wherein the diameter of the milling roller is at least equal to the inner radius of the milling ring. The milling roller is driven by a tangential force. By this arrangement it is guaranteed that the center of mass of the roller runs about the mill's central axis at a constant frequency that does not depend on the wear of the roller or the ring. Furthermore, the axis of rotation of the roller is not tilted during operation such that no torque is generated.

20 Claims, 6 Drawing Sheets

MILLING DEVICE

BACKGROUND OF THE INVENTION

1. Field of the Invention

The invention relates to a milling device having a milling roller, a milling ring and a drive, wherein said milling roller has a diameter substantially equal to or larger than an inner radius of said milling ring and is running along a substantially cylindrical inner surface of said milling ring. Such a milling device is e.g. suited for milling stones to sand.

2. Description of the Prior Art

A milling device of this kind is e.g. described in WO 87/06500 and FR-349 886. Several advantages result from using a mill with such a large milling roller. For one, the rolling friction is reduced considerably when compared to mills having a plurality of smaller rolls arranged in a single plane such as they are e.g. described in EP 0 102 645. Furthermore, mechanical set-up becomes easier because a smaller number of bearings is required, and the large, heavy mass of the milling roller is not easily deflected by hard foreign bodies, such as metals, in the material to be milled.

In conventional milling devices having a single large roller, the milling roller is directly driven for rotation about its central roller axis, which causes the roller to run along the cylindrical inner surface of the milling ring.

Such mills show various disadvantages. Especially, it has been found that the frequency of the center of mass of the milling roller circling the center of mass of the milling ring—the running frequency—depends strongly on the diameter of the milling roller. This effect causes a change in the pressure that the roller exerts on the ring while the milling roller is worn down. Since the pressure should remain constant during operation of the mill, such devices require a complicated regulation and expensive gearings for controlling the drive speed and for constant surveillance of the running frequency.

SUMMARY OF THE INVENTION

Hence, it is a general object of the invention to provide a milling device of the kind mentioned initially that obviates the disadvantages of the known solutions at least partially. Furthermore, the milling device should be easy to construct and reliable.

Now, in order to implement these and still further objects of the invention, which will become more readily apparent as the description proceeds, the milling device is manifested by the features that it comprises a milling roller, a milling ring and a drive, said milling roller having a diameter substantially equal to or larger than an inner radius of said milling ring and running along a substantially cylindrical inner ring surface of said milling ring, wherein said milling roller has a central roller axis and is freely rotatable about said roller axis, and wherein said drive is coupled to said milling roller for exerting a tangential force in respect to said ring surface.

According to this design the roller is not driven rotatively for rotation about its own axis. Rather, it is driven by a tangential force component for running along the inner surface of the milling ring. In this way, the running frequency is directly given by the driving frequency and does not depend on the roller's diameter. The pressure of the roller exerted onto the milling ring depends therefore much less on the roller's diameter and does not significantly vary while the roller is worn down.

Preferably, the milling ring and/or the roller are mounted such that they can be deflected laterally. In this way, the milling ring describes a pendulum movement during operation. The common center of mass of the roller and the ring remains practically stationary. This decreases the dynamic load on the mill's frame.

It is preferred to mount the roller such that its central roller axis does not change direction during operation. This avoids a periodic change of the angular momentum of the roller. In conventional devices where the direction of the roller axis is changed periodically, large torques result that are difficult to support.

Preferably, the roller is mounted on a roller table, which roller table is Cardanically mounted to the milling ring and is driven along a circular path around the central axis of the milling ring. Therefore, the roller and the ring form a commonly mounted unit having a center of mass that remains stationary during operation. This reduces dynamic loads on the mill's frame.

BRIEF DESCRIPTION OF THE DRAWING

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
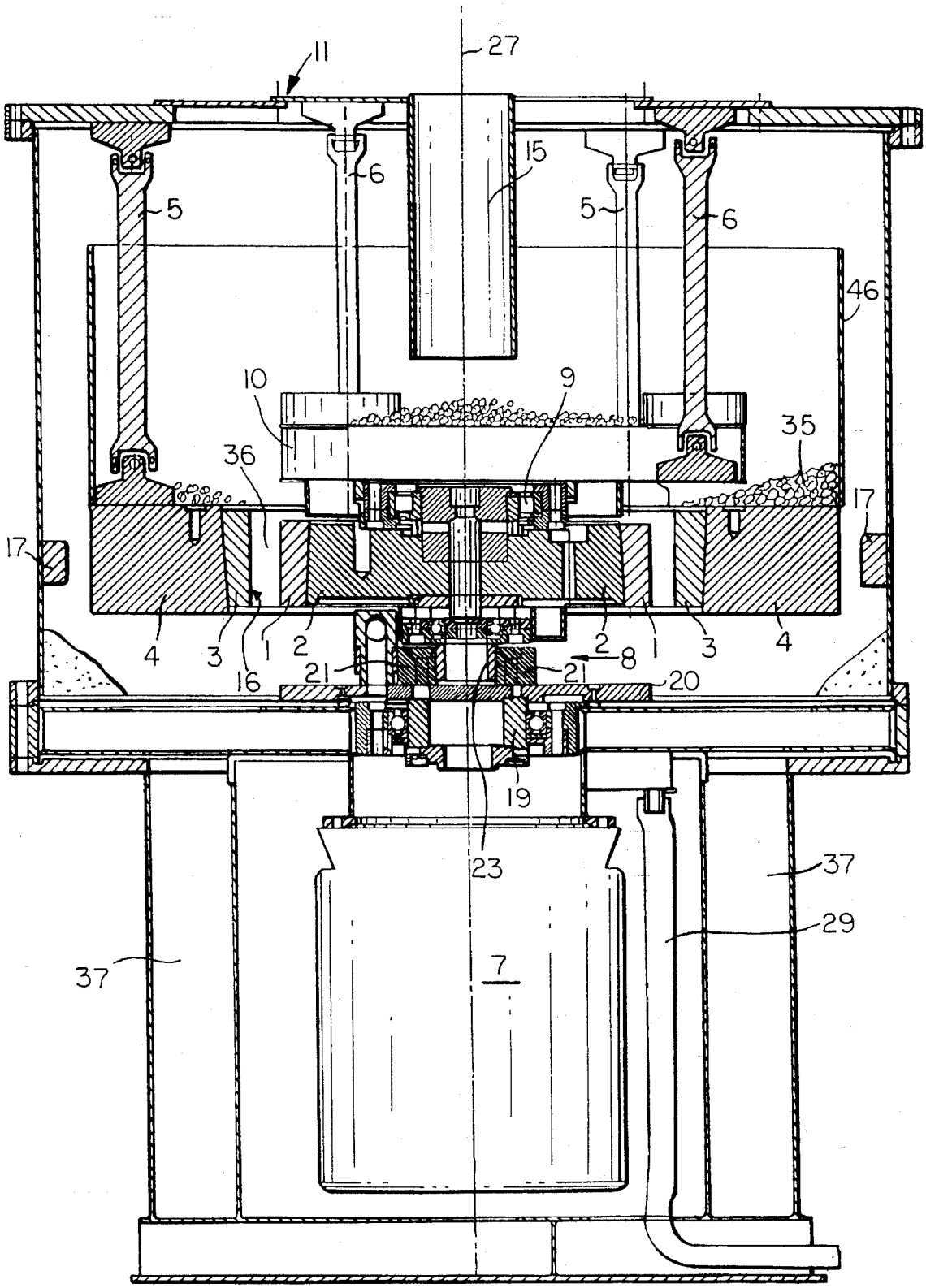
FIG. 1 is a sectional view of a first embodiment of the milling device.

FIG. 1 shows a first embodiment of a milling device for milling stone and gravel as it is e.g. used in the production of concrete.

The most important parts of the mill are the milling roller 1, 2, the milling ring 3, 4, their suspension 5, 6, the motor 7 with the coupler 8 between motor 7 and milling roller 1, 2.

Milling roller 1, 2 consists of an outer shell 1 of hard steel, e.g. hard manganese steel, and a core 2 of aluminum. It is mounted to a roller holder 10 by means of a rotational bearing 9. Rotational bearing 9 is coaxial to the axis of milling roller 1, 2. Therefore, milling roller 1, 2 can be rotated relative to roller holder 10 about its central roller axis.

Roller holder 10 is suspended to a cover 11 of the mill's frame by three Cardan shafts 6 shown schematically. Each Cardan shaft 6 consists of three rigid sections joined by two Cardanic joints. By using at least one Cardanic shaft, a rotation of the roller holder 10 in respect to the frame of the mill is prevented without hindering a lateral movement of the roller holder 10.

Figure 3:
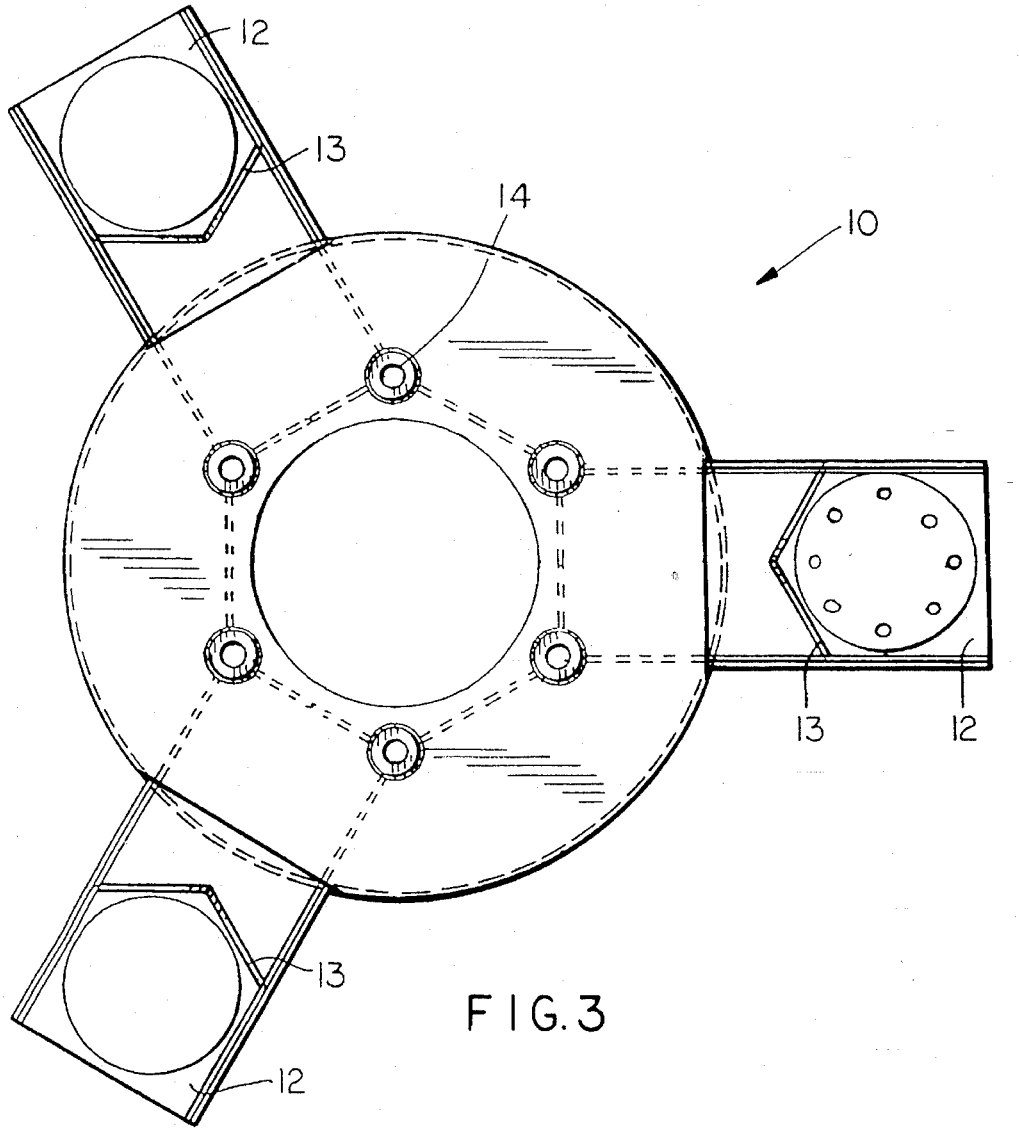
FIG. 3 is an top view of the roller holder.
Figure 4:
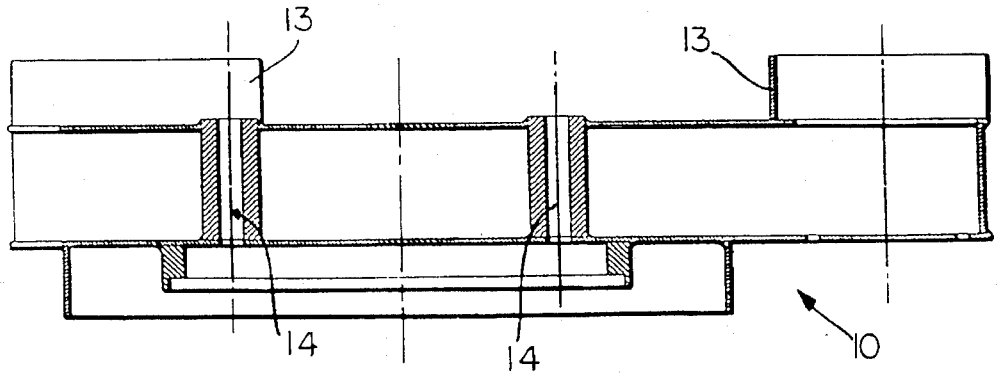
FIG. 4 is a sectional view of the roller holder of FIG. 3.

Roller holder 10 consists of the support structure as shown in FIGS. 3 and 4. It comprises three arms 12 for receiving Cardan shafts 6. Guiding plates 13 for guiding the material to be milled are mounted on arms 12. The screws for attaching the bearing 9 are introduced into six holes 14. The roller holder simultaneously acts as a support for the milling roller and as a distributing plate for the goods to be milled falling through opening 15 (see FIG. 1).

In FIG. 1 milling ring 3, 4 can be seen located around milling roller 1,2. It consists of an inner layer 3 of hard steel, the inner surface 16 of which is used for milling, and an outer ring 4, which can be of a softer material. Milling ring 3, 4 is connected to cover 11 of the mill's frame by means of three Cardan shafts 5 mutually displaced by 120°. Also here, using at least one Cardan shaft prevents a rotation between milling ring 3, 4 and the mill's frame without hindering a lateral movement of the ring.

A cylindrical guiding plate 46 is arranged on milling ring 3, 4. It prevents material from falling over the outer edge of the ring.

Outside the ring 4, a rubber ring 17 is mounted to the mill's housing. It damps strong pendulum motions of milling ring 3, 4. Such strong pendulum motions can occur during start-up of the mill while the running frequency is close to the Eigenfrequency of the pendulum body.

Motor 7 is a 30 kW three phase motor. It is coupled to an axis shaft 19 by means of a conventional gearing or coupling 18. Axis shaft 19 is rotating a driving table 20.

Figure 2:
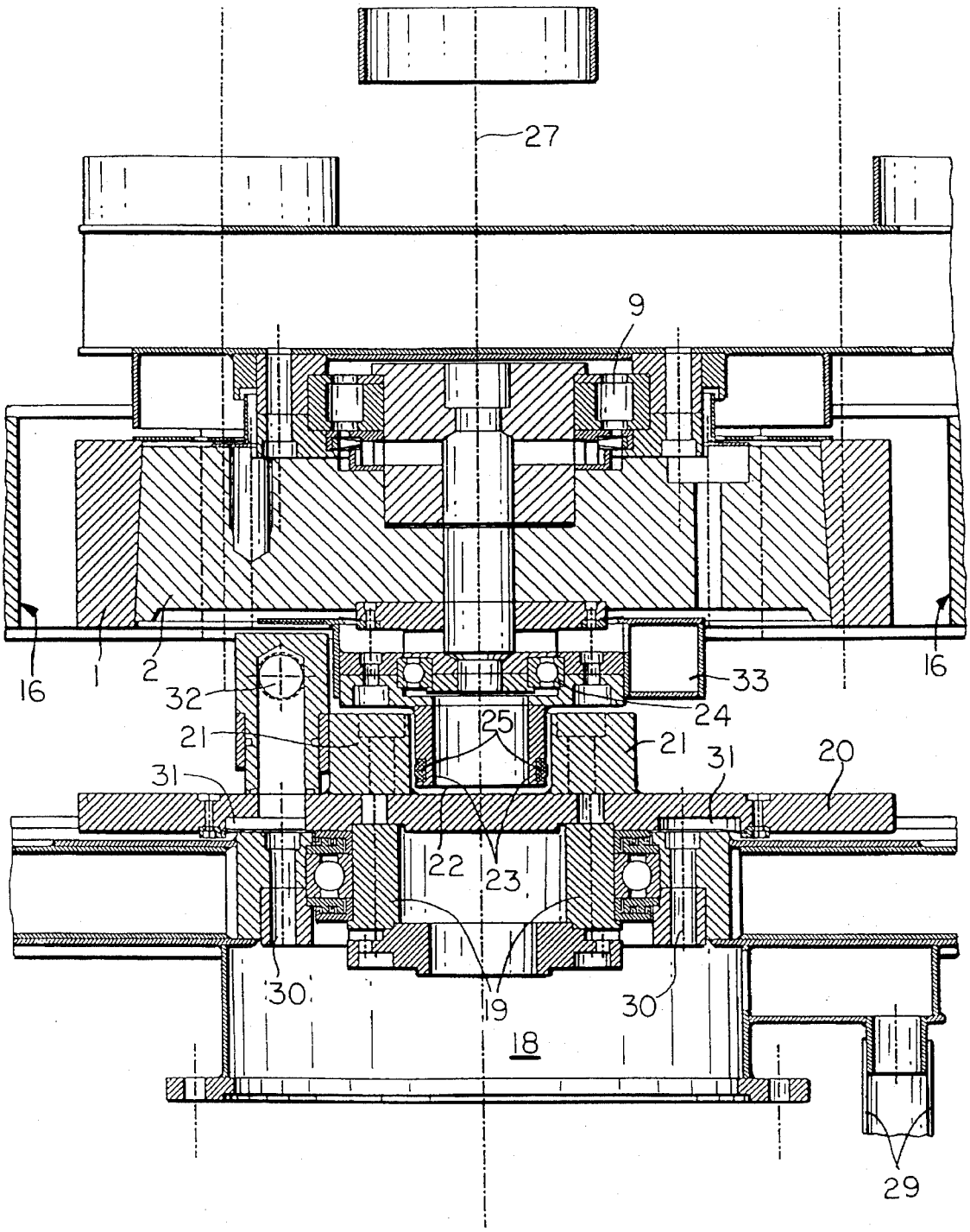
FIG. 2 shows an enlarged view of the central part of FIG. 1.

As can be best seen from FIG. 2, two parallel bars 21 are arranged on driving table 20. A guiding track 22 is formed between the two bars 21. A foot 23 is extended from above into track 22. Foot 23 has a rectangular horizontal cross section and comprises lateral sliding bearings 25 (e.g. made of Teflon or Nylon). It is axially connected to the milling roller 1, 2 by means of a bearing 24.

Figure 5:
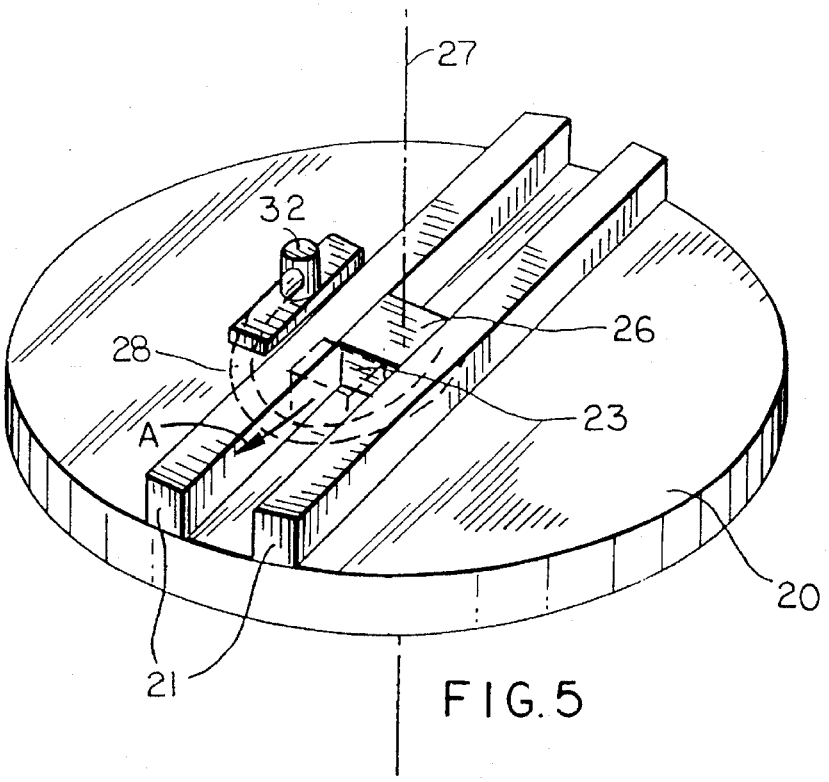
FIG. 5 shows a schematic view of a coupling between the drive and the milling roller.

The three-dimensional arrangement of the bars 21 and foot 23 is schematically illustrated in FIG. 5, where various irrelevant details have been omitted. It shows a view of the driving table 20 with the rods 21. Foot 23 extends into the gap between the rods from above and is shown in dashed lines without the components located above it. A stopper 26 is mounted between the rods 21. It forms a rest for urging foot 23 out of the mill's center while the mill is not operating. This guarantees a secure start-up of the mill. As soon as the motor is started, foot 23 will move along the gap between the rods 21 as indicated by arrow A until roller 1, 2 comes into contact with milling ring 3, 4.

Milling roller 1, 2 must be coupled to the drive in such a way that the drive can exert a tangential force component without obstructing a horizontal or vertical movement of the roller. For this purpose, it is e.g. also possible to use a rope or a chain arrangement between table 20 and milling roller 21 instead of the rods 21 and the foot 23. Other couplings, such as oil couplings or electromagnetic couplings can be used as well. It is important, however, that it is possible to transmit a force component directed tangentially to the central mill axis 27.

FIG. 5 further illustrates the arrangement of a pressure hose 28, which is part of an air pressure system for keeping dust from the bearings. For this purpose, pressurized air is transmitted through a hose 29 to bearing or coupling 18, as it is shown in FIG. 2. From there, it enters openings 30 and a circular channel 31 to arrive at nozzle 32 on the driving table. It is guided through the flexible hose 28 into a cavity 33 below the milling roller 1, 2, from where it can reach bearings 9 and 24. In this way, all dust sensitive parts of the mill are under elevated pressure and dust can be prevented from entering. The pressurized parts of the mill are sealed by means of conventional sealings.

Figure 6:
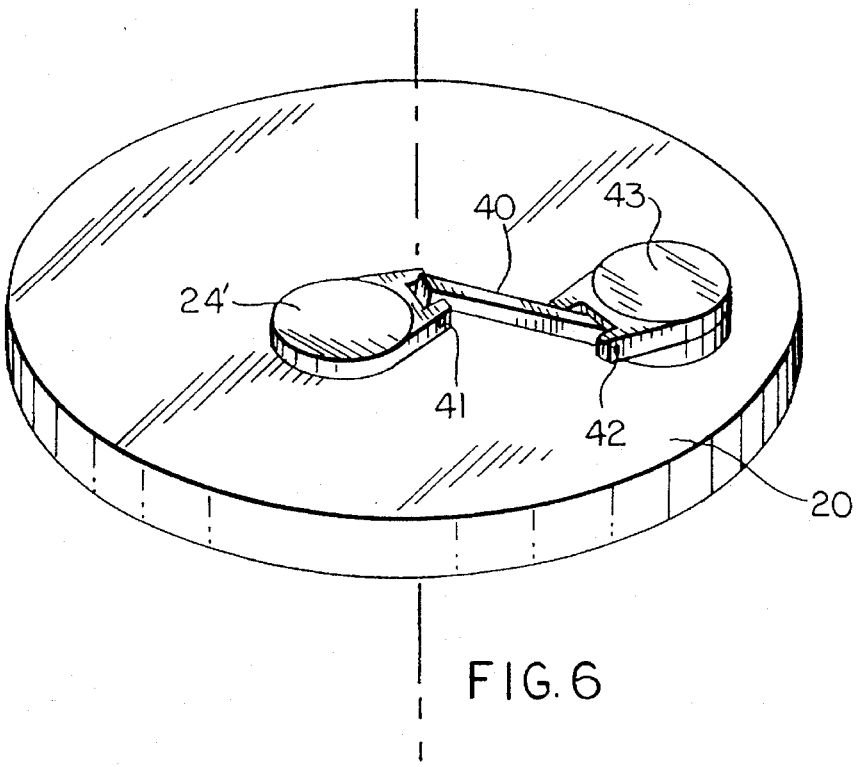
FIG. 6 shows an alternative embodiment of the coupling between the drive and the milling roller.

FIG. 6 shows an alternative embodiment of the coupling between motor and roller. Here, rods 21 and foot 23 are replaced by a movable rod 40. On its upper end, rod 40 is provided with a hinge 41 with horizontal hinge axis connecting rod 40 to the rotational bearing 24'. Bearing 24' replaces bearing 24 of FIG. 2 and allows a rotation of the roller in respect to rod 40. On its lower end, rod 40 is connected to a lower rotational bearing 43 by means of a second hinge 42. Rotational bearing 43 is mounted to driving table 20 and allows rod 40 to follow radial movements of the center of the roller. Hinges 41 and 42 are provided for compensating vertical movements of the roller.

During operation, the goods to be milled are entered through opening 15, arrive on roller support 10 and fall over its lateral edges. Lateral cones 35 of material are formed and the material falls into the gap 36 between roller and ring. The running speed of the roller is chosen such that material falling through gap 36 is certainly caught and milled, i.e. that the minimum time required for falling through gap 36 is larger than the inverse running frequency of the roller. The milled material then falls through a cylindrical space 37 located around motor 7 and leaves the mill through openings in the floor (not shown).

Figure 7:
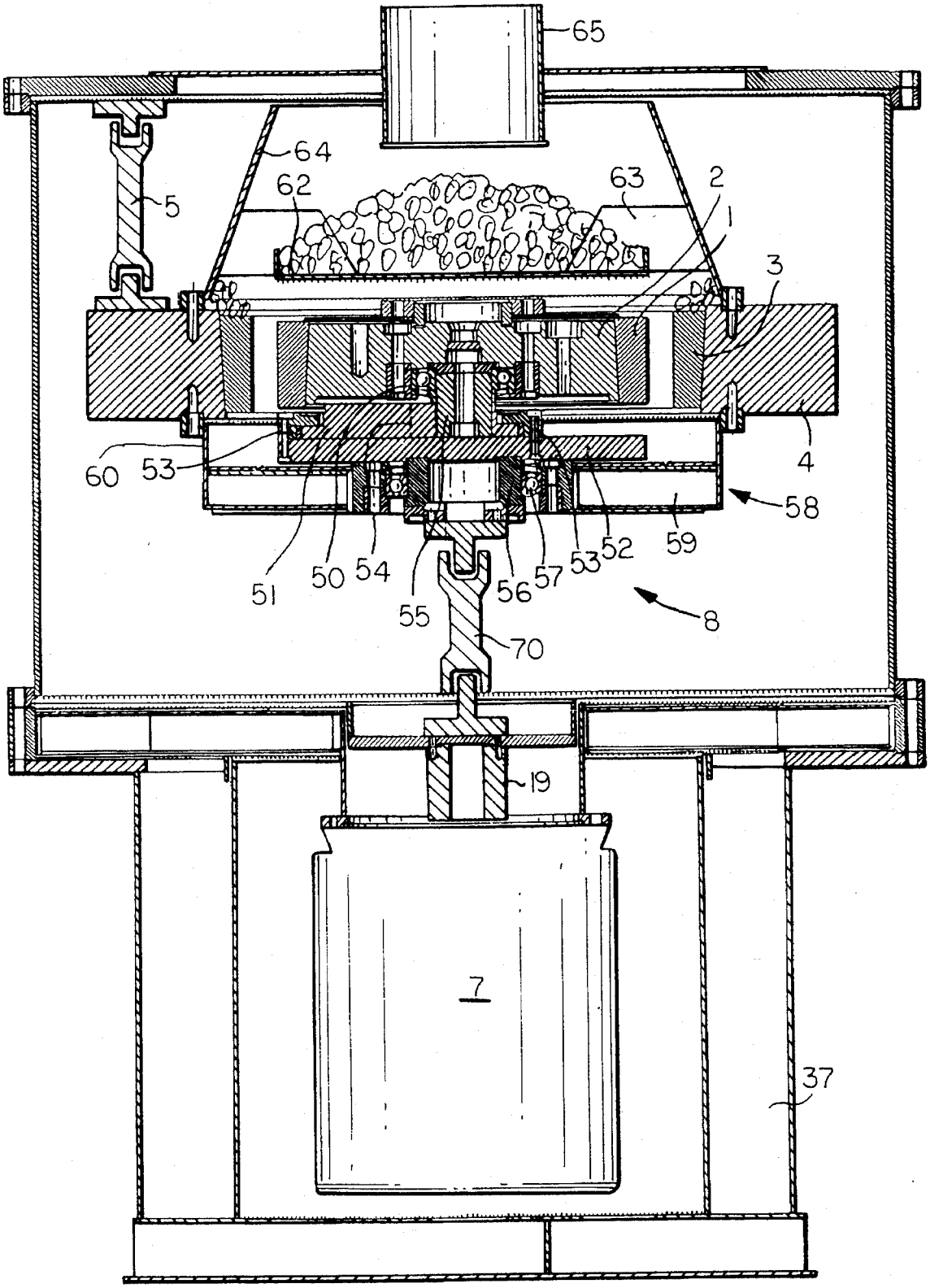
FIG. 7 is a sectional view through a second embodiment of the milling device.

A second embodiment of the mill is shown in FIG. 7. The mill shown here has the same basic set-up as the mill of FIG. 1 with a milling roller 1, 2, milling ring 3, 4, motor 7 and coupling means 8 between motor 7 and milling ring 1, 2. Again, coupling means 8 is provided for exerting a force onto roller 1, 2 that is substantially tangential to the milling ring 3, 4 and perpendicular to the ring's central axis. This force drives roller 1, 2 for running along the inner surface of milling ring 3, 4.

In contrast to the embodiment of FIG. 1, milling roller 1, 2 is not directly suspended on the mill's frame or its cover. Rather, it rests on an eccentric plate 51 and is connected thereto by means of a bearing 50 and an eccentric stub 55. Eccentric plate 51 rests on a roller table 52, is guided by lateral guidings 53 and can be rotated about its central axis 54.

An axis shaft 56 of roller table 52 is mounted to a table holder 58 by means of a bearing 57. Table holder 58 comprises radial struts 59 and a cylindrical outer wall 60. Cylindrical wall 60 is rigidly connected to the outer part 4 of milling ring 3, 4.

Axis shaft 56 of roller table 52 is further connected to motor 7 via a Cardan shaft 70. Alternatively, motor 7 can be flanged directly to holder 58.

A distributing table 62 is provided above milling roller 1, 2. It is welded to radial plates 63, which are in turn welded to a frusto-conical support 64 that also carries inlet opening 65. Support 64 forms a circumferential wall for preventing material from faling over the outer edge of ring 3, 4.

In operation, motor 7 drives roller table 52 through Cardan shaft 70 to rotate it about the ring's central axis. Eccentric plate 51 is therefore running eccentrically around the central axis. It will be re-oriented such that stub 55 is moved away from the central axis until roller 1, 2 comes into contact with ring 3, 4. Centrifugal action will urge milling roller 1, 2 against milling ring 3, 4, and the roller will roll along the inner surface of the ring.

Figure 8:
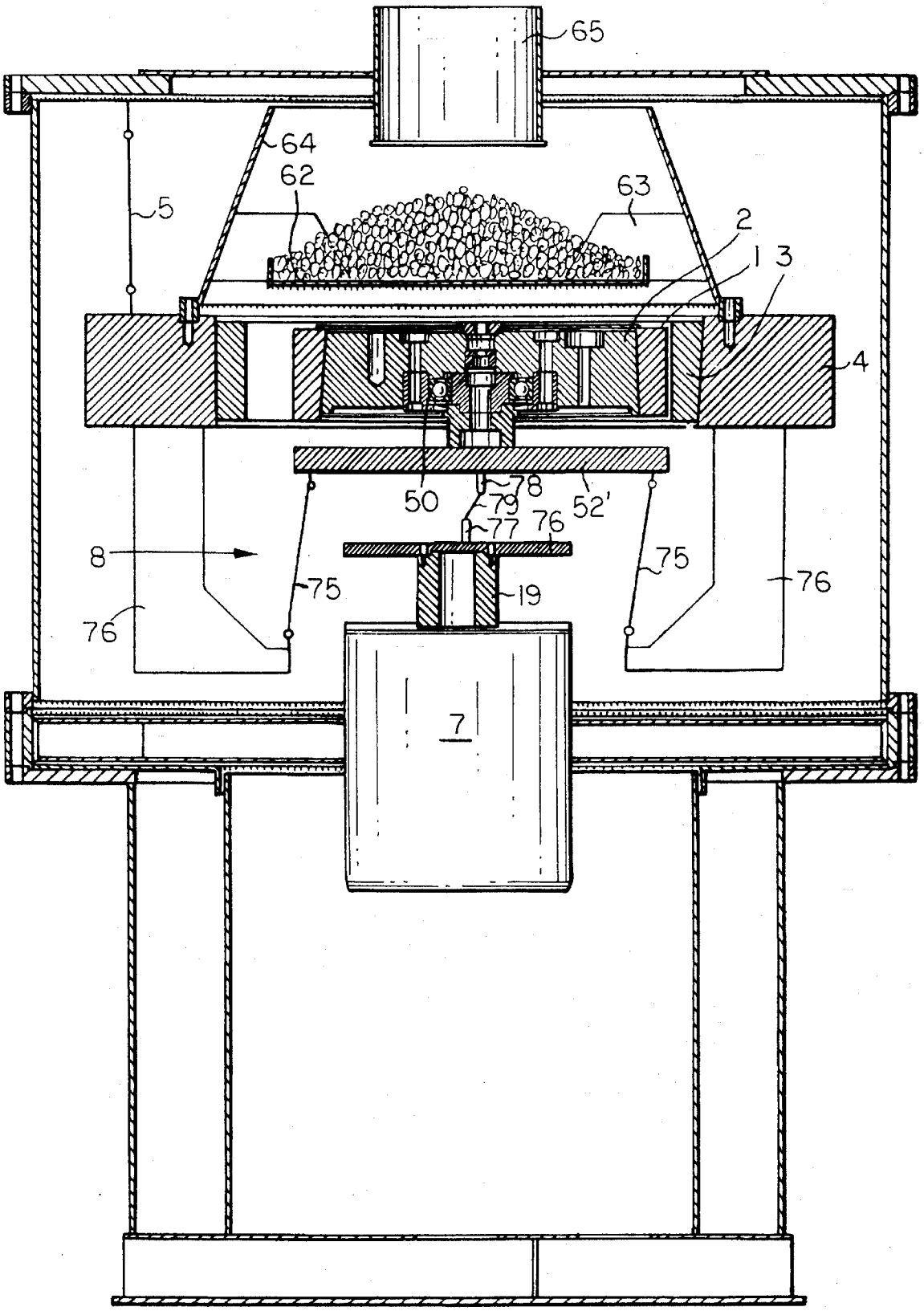
FIG. 8 is a sectional view through a third embodiment of the milling device.

A third, presently preferred embodiment is schematically shown in FIG. 8. The mill shown here has the same basic set-up as the mill of FIG. 1 and 7 with a milling roller 1, 2, milling ring 3, 4, motor 7 and coupling means 8 between motor 7 and milling ring 1, 2. Again, coupling means 8 is provided for exerting a tangential force onto roller 1, 2 to drive it for running along milling ring 3, 4.

As in the embodiment of FIG. 7 the milling roller 1, 2 is suspended on the milling ring 3, 4. For this purpose, milling roller 1, 2 is mounted to a roller table 52' by means of a central bearing 50. Roller table 52' and milling roller 1, 2 can therefore be rotated coaxially in respect to each other. Roller table 52' is resting on four Cardanic shafts 75, two of which are schematically shown in FIG. 8. The Cardanic shafts 75 are mounted to supporting elements 76, which are rigidly connected with the outer part 4 of the milling ring. Therefore, milling roller 1, 2 and milling ring 3, 4 again are forming a dynamic unity with a common, Cardanic suspension 5.

Motor 7 is mounted on the frame of the mill. A motor table 76 is resting on its axis 19. A rope coupling 77–79 is provided for coupling motor table 76 and roller table 52'. This rope coupling comprises a first anchor 77 mounted eccentrically on the motor table 76 and a second anchor 78 mounted on the roller table 52'. A rope 79 is pivotally coupled to both anchors 77, 78. The mutual position of the anchors and the length of the rope are designed such that roller table 52' is pulled along a circular path about the mill's central axis by the rotational movement of the motor table 76. The radius of the circular path is sufficiently large for the milling roller 1, 2 to come into contact with the milling ring 3, 4, such that it can roll along its inner surface.

Instead of the rope coupling 77–79 a coupling of the type shown in FIGS. 5 or 6 can be used as well.

In FIG. 8, motor 7 is shown to be coaxial with the mill's central axis. It can, however, also be displaced out of the mill's central axis if the coupling 77–79 is displaced by the same distance.

The radius r of milling roller 1, 2 initially is 35 cm, the inner radius R of milling ring 40 cm. During operation, roller and ring are worn down such that r can be as small as 30 cm and R as large as 45 cm.

Because the frequency of the motor directly determines the running frequency F (i.e. to rotation frequency of the center of mass of the roller about the mill's central axis), this frequency remains constant. Therefore, the pressure exerted by the roller onto the ring is only weakly dependant on the wear of roller and ring. A preferred running frequency of the present embodiments is 750 rotations per minute.

In the inventive construction, running frequency F is equal to the frequency of rotation of the driving table and the motor. The rotation frequency W of the roller about itself is not equal to F but depends strongly on the ratio r/R. If r/R is close to 1, F/W becomes large. In practice, this leads to no further problems in the inventive mill.

In contrast to this, conventional mills, as they are e.g. shown in WO 87/06500, have a running frequency F of the roller's center of mass given by formula $F=f\times r/(R-r)$, wherein f is the rotation frequency of the motor and the roller. Therefore, the running frequency F of the center of mass of the roller depends strongly on the wear of the ring and the roller if r is close to R. For maintaining constant milling conditions, the drive must be provided with a speed regulation and a large gearing, which makes the conventional mill design expensive and cumbersome. The invention circumvents this problem.

While there are shown and described presently preferred embodiments of the invention, it is to be distinctly understood that the invention is not limited thereto but may be otherwise variously embodied and practiced within the scope of the following claims.

I claim:

1. A device for milling comprising:

a static frame, a milling ring laterally displaceable suspended in said frame, said milling ring having a cylindrical inner ring surface and defining a vertical central axis, a milling roller mounted to said ring, having a diameter substantially equal to or larger than an inner radius of said milling ring and rolling along said inner ring surface for crushing material falling vertically through a gap between said milling roller and said milling ring, said milling roller having a vertical central roller axis parallel to said central ring axis during milling and being freely rotatable about said roller axis, a drive for exerting a driving force to said milling roller, said driving force being tangential in respect to said ring surface, and mounting means for mounting said roller to said ring so that said roller and said ring form a commonly mounted unit that can be deflected laterally during milling with said unit having a center of mass that is substantially stationary during operation, said mounting means including roller suspension means suspended from said ring for preventing said roller from tilting from a vertical axis during milling while allowing a relative displacement of said roller in respect to said ring.

2. The milling device of claim 1 wherein the roller suspension means comprises roller holding means for holding said milling roller laterally displaceable and rotatable about said roller axis while preventing a tilting of said roller axis, wherein said roller holding means is mounted to said milling ring.

3. The milling device of claim 2, wherein said roller holding means comprises a roller table and a table holder, wherein said table holder is mounted on said milling ring and rotatably holding said roller table.

4. The milling device of claim 3 further comprising a driving Cardan shaft coupling said drive to said roller table.

5. The milling device of claim 1, comprising ring suspension means for suspending the milling ring from the frame so as to prevent a rotation between the milling ring and the frame without hindering lateral displacement of the milling ring.

6. The milling device of claim 5 wherein the ring suspension means comprises at least one suspending Cardan shaft coupling said milling ring to said frame.

7. The milling device of claim 1 comprising a coupling means for coupling said milling roller to said drive, wherein said milling roller is freely rotatable about said roller axis in respect to said coupling means.

8. The milling device of claim 7 wherein said coupling means comprises at least two couplers, a first of which couplers is driven by said drive along a circular path and a second of which couplers is rotatably mounted to said milling roller, wherein said couplers are positioned for abutting on each other.

9. The milling device of claim 7 wherein said coupling means comprises a driving table rotatably driven by said drive and a coupling member being pivotally mounted to said driving table and being pivotally mounted to said milling roller.

10. The milling device of claim 1 further comprising a roller table being driven for rotation, an eccentric driving member mounted to said roller table and rotatable about an eccenter axis, a bearing mounted to said eccentric driving member and rotatably holding said milling roller, wherein said eccenter axis is at a distance from said roller axis.

11. The milling device of claim 1 further comprising a roller table being driven along a circular path and a rotational bearing coaxially coupling said roller table and said milling roller, wherein said roller table is Cardanically mounted to said milling ring.

12. The milling device of claim 1 further comprising a distributing table mounted to said milling ring and located above said milling roller.

13. The milling device of claim 1 wherein said roller axis is extending in a vertical direction.

14. The milling device of claim 1 comprising means for damping a pendulum movement of said milling ring.

15. The milling device of claim 1 further comprising a circular wall mounted on said milling ring.

16. A device for milling comprising:

a) a static frame;

b) a milling ring having a cylindrical inner ring surface;

c) ring suspension means for suspending said milling ring from the frame i) so that the milling ring defines a vertical central axis, ii) so as to permit lateral displacement of the ring in the frame and iii) so as to prevent a rotation between the milling ring and the frame without hindering said lateral displacement;

d) a milling roller having a diameter substantially equal to or larger than an inner radius of said milling ring;

e) mounting means for mounting said roller to said ring i) so that said roller has a vertical central axis and is freely rotatable therearound, ii) so that said roller and said ring form a commonly mounted unit that can be deflected laterally during milling with said unit having a center of mass that is substantially stationary during operation and iii) so that said inner ring surface and an outer edge of the roller define a gap through which material to be milled can fall, said mounting means including roller suspension means suspended from said ring for preventing said roller from tilting from a vertical axis during milling while allowing a relative displacement of said roller in respect to said ring;

f) distribution means mounted to said milling ring and disposed above said milling roller for distributing the material to be milled so that it falls vertically through said gap;

g) a drive for exerting a driving force to said milling roller; and h) coupling means for coupling the drive to the roller so that said driving force is substantially tangential to said ring surface whereby said milling roller has a vertical central roller axis parallel to said central ring axis during milling and rolls along said inner ring surface for crushing material falling vertically through the gap.

17. A device for milling as claimed in claim 16 wherein the distribution means comprises wall means for preventing the material to be milled from falling over an outer edge of the ring.

18. A device for milling as claimed in claim 17 wherein the wall means comprises a circumferential wall mounted to the milling ring.

19. A device for milling as claimed in claim 18 wherein the distribution means comprises a distribution table above the milling roller and mounted to the circumferential wall, and wherein the drive is disposed below the milling roller.

20. A device for milling as claimed in claim 18 wherein the distribution means comprises a distribution table above the milling roller and inlet opening means for introducing material to be milled onto the distribution table through an opening in a top portion of the frame.

* * * * *